US005560149A

United States Patent [19]

Lafevre

[11] Patent Number: 5,560,149

[45] Date of Patent: Oct. 1, 1996

[54] STORM RESISTANT WINDOW

[76] Inventor: Michael C. Lafevre, 305 Falls of Venice, Sarasota, Fla. 34292

[21] Appl. No.: 327,635

[22] Filed: Oct. 24, 1994

[51] Int. Cl.[6] ..... E06B 3/00

[52] U.S. Cl. ..... 49/501; 49/404; 49/449; 52/204.51; 52/204.62; 52/207; 52/775

[58] Field of Search ..... 49/501, 404, 504, 49/449, 406; 52/207, 775, 780, 204.7, 204.62, 204.75, 204.51, 204.53

[56] References Cited

U.S. PATENT DOCUMENTS

| | | | |
|---|---|---|---|
| 2,576,260 | 11/1951 | Metts | 189/64 |
| 2,734,601 | 2/1956 | Anderson | 189/75 |
| 3,208,110 | 9/1965 | Griffin | 52/207 X |
| 3,403,491 | 10/1968 | Eichman | 52/775 X |
| 3,600,857 | 8/1971 | La Barge | 49/404 |
| 3,691,713 | 9/1972 | Dulaney | 52/775 X |
| 3,762,118 | 10/1973 | Sanders | 52/171 |
| 4,077,167 | 3/1978 | Rieder | 52/106 |
| 4,395,847 | 8/1983 | Atchison | 49/406 |
| 4,420,907 | 12/1983 | Swan | 49/501 X |
| 4,654,928 | 4/1987 | Flight | 16/199 |
| 4,724,597 | 2/1988 | Johnson | 29/462 |
| 4,800,680 | 1/1989 | Westfall et al. | 49/429 |
| 4,823,511 | 4/1989 | Herliczek et al. | 49/404 |
| 4,831,781 | 5/1989 | Morton | 49/504 |
| 4,941,288 | 7/1990 | Morton | 49/504 |
| 5,003,747 | 4/1991 | Morton | 52/656 |
| 5,099,624 | 3/1982 | Valentin | 49/404 X |
| 5,119,592 | 6/1992 | Westfall et al. | 49/454 |
| 5,363,596 | 11/1994 | Kronbetter | 49/404 X |
| 5,426,897 | 6/1995 | Gazaway | 52/204.62 X |

FOREIGN PATENT DOCUMENTS

| | | |
|---|---|---|
| 1482287 | 8/1977 | United Kingdom . |
| 2055937 | 3/1981 | United Kingdom . |

*Primary Examiner*—Philip C. Kannan
*Attorney, Agent, or Firm*—Eckert Seamans Cherin & Mellott

[57] ABSTRACT

A storm resistant window has a window frame and a window sash of preferably-aluminum extruded frame members, a glass and polymer safety glass, clamping glazing beads that bear sealingly on the glass, and a sash locking clasp arrangement. The window resists impacts characteristic of wind-blown hurricane debris, for example, and is resilient enough to damp wind loads induced by 75 mph (120 kph) winds, with resilient arching and twisting of the frame members. The clamping glazing beads are snap-fitted to lock tightly in the associated superstructure around the glazing, deforming resilient weatherseals against the outer surface of the safety glass. The safety glass has coextensive annealed glass and polymer layers. An additional polymer strip and a bead of adhesive affix the glazing on the inside for resisting abrasion of the polymer side against the frame. The window includes a latch for a positive locking connection between the frame and the sash within the frame.

13 Claims, 7 Drawing Sheets

STORM RESISTANT WINDOW

BACKGROUND OF THE INVENTION

1. Field of the Invention

The invention relates to a window construction particularly adapted to resist conditions encountered during extreme storms. The window construction is used in an exterior window for a commercial or residential building, or a sliding glass door as typically leads between an interior room and a back porch or patio. The window construction functions as an integral part of the external protection for the building envelope, whether used as a window or sliding glass door, and includes high impact panes mounted in a structure of extruded frame parts in a manner that resists damage from pressure cycling and debris impact.

2. Prior Art

Exterior windows and/or sliding glass doors mounted in the walls of a commercial or residential buildings are intended to provide a weather-tight barrier against wind and rain. A window or sliding glass door also permits a view, and preferably has the capability of being opened during favorable conditions. It is possible to make a window or sliding glass door into a substantial barrier; however its viewing aspects and opening capabilities may suffer, and the expense of the window or door typically is increased. On the other hand, if the window or sliding glass door does not form a sufficient barrier, it may be damaged under extreme storm conditions.

Extreme storm conditions characterized by strong winds and rain, airborne debris and/or hail, occur yearly in various locales. Such conditions may occur in hurricanes or near tornadoes, or even in particularly strong thunderstorms. For example, in South Florida and along the Gulf Coast, hurricanes occur yearly or oftener.

In a strong storm, an exterior window or sliding glass door might be subject to winds of 75 mph (120 kph) or greater. Wind loading can be sustained, e.g., continuing for the greater part of a minute, or can occur in gusts and ripples. Both sustained and intermittent wind loading can cause structures to oscillate, and to withstand such loading, structures require both static strength and resilience.

Gale force winds load windows and/or sliding glass doors structurally and drive rain against the window or door and its seals. Moreover, such winds can carry debris. Smaller particles such as sand and gravel can damage window panes. In a strong storm, large missiles become airborne, such as pieces of roofing, loose lawn furniture and even structural parts of damaged buildings. A 9 foot (2.7 m) nominal 2×4 timber stud (5 cm×10 cm), weighing between 9 and 9.5 lbs (4.1 and 4.3 kgms) flung at a window at a speed of 34 mph (55 kph) or greater, for example, is a formidable missile. However wind borne debris of this type is not unusual in a hurricane.

Conventional windows and/or sliding glass doors for commercial and residential buildings generally have not been designed to withstand and/or resist such extreme weather. When subjected to high winds and debris, windows or sliding glass doors have failed or broken apart, allowing the weather and debris to invade the building envelope, and potentially leading to further structural damage due to a breach of structural integrity.

Experience has taught that hurricanes result in great losses, not only in property but in lives. What is needed is an improved window construction utilized in windows and sliding glass doors alike that better resists such extreme weather and/or storms. However, improved strength and debris resistance should be achieved without adversely affecting aesthetic aspects such as sufficient view and opening capability, and without unduly increasing costs.

SUMMARY OF THE INVENTION

It is an object of the invention to provide a window construction, such as used in an exterior window or a sliding glass door, which is resistant to storms for improved effectiveness as an integral part of the external protection for a building envelope.

It is another object of the invention to make the above window construction from tough materials that can withstand substantial impact from windborne debris, yet are sufficiently resilient and resiliently connected so as to arch and twist for damping loads induced by wind and rain.

It is a further object of the invention to employ extruded aluminum parts in the above window construction, such that the window construction can be mass produced at a reasonable cost.

It is an additional object of the invention to form the extruded parts with C-shaped bosses so that a window frame, door frame, and/or a sash frame can be fastened together with screw fasteners.

It is yet another object of the invention to employ safety glass panes between adhesive and seals in the window construction, which in turn are mounted between parts that lock together without fasteners and induce substantial deformation in the adhesive and seals.

It is an optional object of the invention to incorporate the above window construction in a structure with at least one movable sash, such as vertically or horizontally slidable sash member in a window, or a horizontally slidable door panel in a sliding glass door, wherein the structure includes a fixed sash member as well to which the movable sash member can be latched by a latch mechanism.

These and other aspects and objects are provided according to the invention in a storm resistant window construction. The window construction has a window frame formed from left and right frame members connected to upper and lower frame members. These members are preferably extruded pieces, for example of aluminum. The frame members are formed with C-shaped bosses. These C-shaped bosses allow the frame members to be connected together by screws.

The frame members are formed with locking formations which permit engagement with an additional extruded part, namely extruded glazing beads. Each glazing bead includes complementary locking means for locking with the locking formations on the frame members such that a panel of safety glass, seals and adhesive are gripped therebetween, inducing deformation in the seals and adhesive for good sealing as well as a resilient structural connection.

The safety glass comprises at least one layer of annealed glass affixed to a multilayer composite of polymer materials. The safety glass is preferably oriented in the frame members such that the adhesive abuts a polymer layer and the resilient seal abuts the annealed glass. The multi-layer polymer composite preferably comprises an impact-resistant layer and a laceration-resistant layer, as chosen from the groups of polyvinylacetal polymers and polyvinylalchohol or polyethylene terephthalate polymers, respectively.

The frame members optionally are extrusions of alloys of aluminum, however extrusions of polymers are similarly advantageous. The adhesive can comprise silicone, or room temperature vinyl, glue or the like. A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
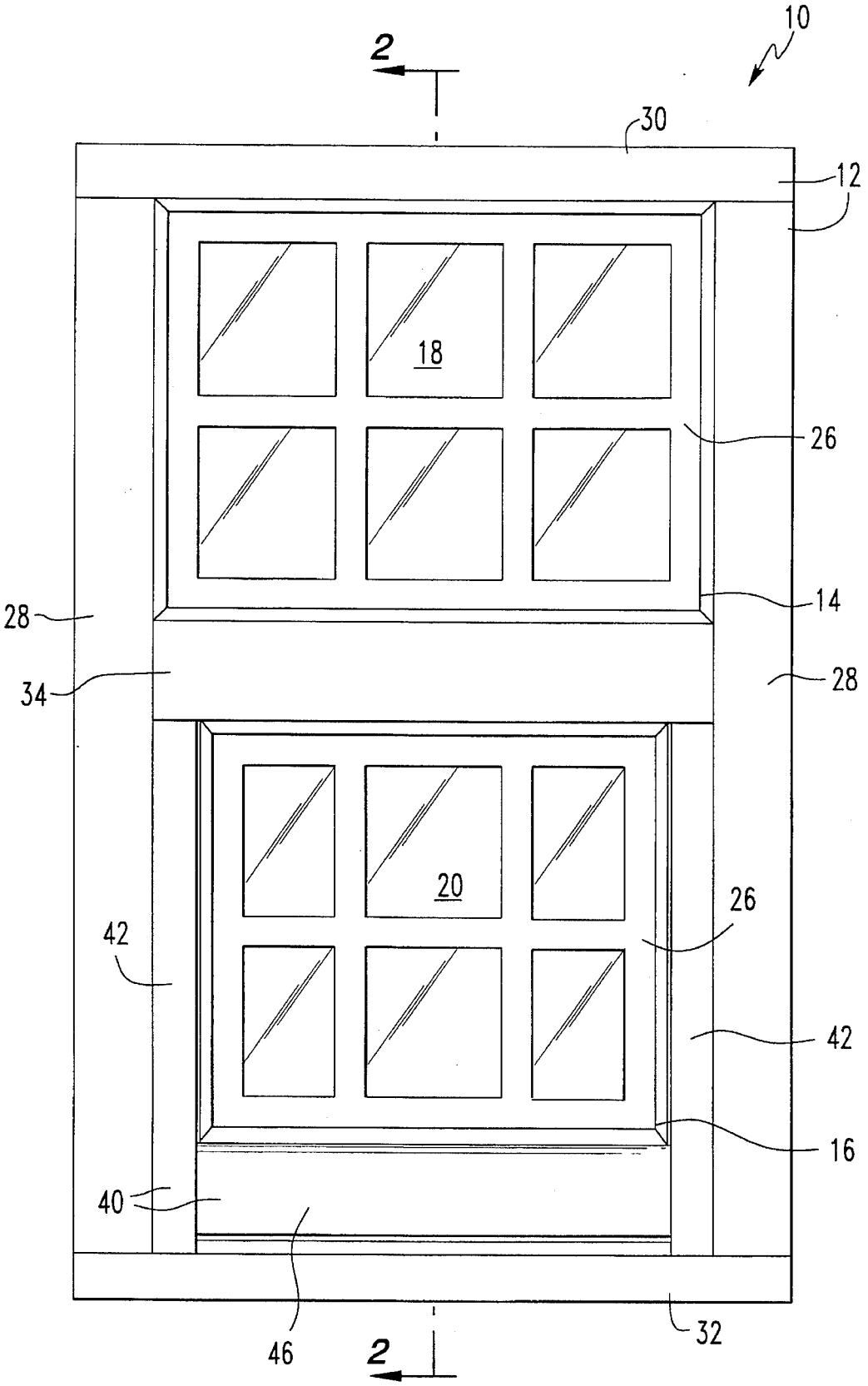
FIG. 1 is an elevation view of a window construction in accordance with the invention, as used in a single-hung exterior window which is viewed from an outdoor vantage point.

In FIG. 1, an exterior window 10 incorporates the storm-resistant window construction aspects of the invention. The window 10 is representative of a single-hung window type because the window 10 includes a fixed frame and sash 12 and 14, respectively, and a movable, or vertically-slidable sash 16. The storm-resistant window construction aspects of the window 10 can be advantageously used in other window types, including but not being limited to skylights, double hung windows, horizontally slidable windows, and/or sliding glass doors. The window 10 is disclosed in particularity here merely for convenience in this description and does not exclude the storm-resistant window construction aspects being used in other types of windows in accordance with the invention.

The window 10 is mounted in a vertical wall (not shown) or like structure of a building, and is shown from the outdoor side (assuming the window 10 is mounted in an exterior wall). The storm-resistant window construction aspects of the window 10 is particularly advantageous for exterior walls of commercial and residential buildings; however the window 10 including the storm-resistant window construction aspects can be advantageously employed in other types of buildings and in other situations, such as a partition that subdivides indoor compartments, in a wall of an open garage or warehouse, in a wall in which both sides of the window 10 are exposed to the weather, and so on. Accordingly, terms like "inner" and "outer", "indoor" and "outdoor", and "left" and "right", are used merely for convenience in this description and do not limit the use or structural relationships of the window 10.

As previously stated, the window 10 comprises the frame 12, the upper preferably-fixed sash 14 and the lower movable sash 16 (upper and lower being relative to the positions shown in FIG. 1). Each sash 14 and 16 includes a panel of glazing 18 and 20 such as safety glass. Additionally, each sash 14 and 16 optionally carries a grid panel forming artificial muntins 26, fixed as shown to extend over an outdoor side of the glazing 18 or 20 for decorative purposes and to resemble a window of individual glass panes.

The window frame 12 comprises a pair of generally vertical jamb members 28 that have upper and lower ends flush against complementary portions of a generally horizontal head and sill members 30 and 32, respectively. The frame members 28–32 are segments of extruded pieces, preferably of aluminum although other materials are functionally equivalent, such as extrudable polymers, among others. The frame members 28–32 are preferably connected together via screw fasteners. Welded seams, among other connection options, are also possible and are not excluded. The window frame is subdivided by a fixed meeting rail 34, which extends generally horizontally between the spaced jamb members 28 and is likewise preferably connected by screw fasteners.

Figure 2A:
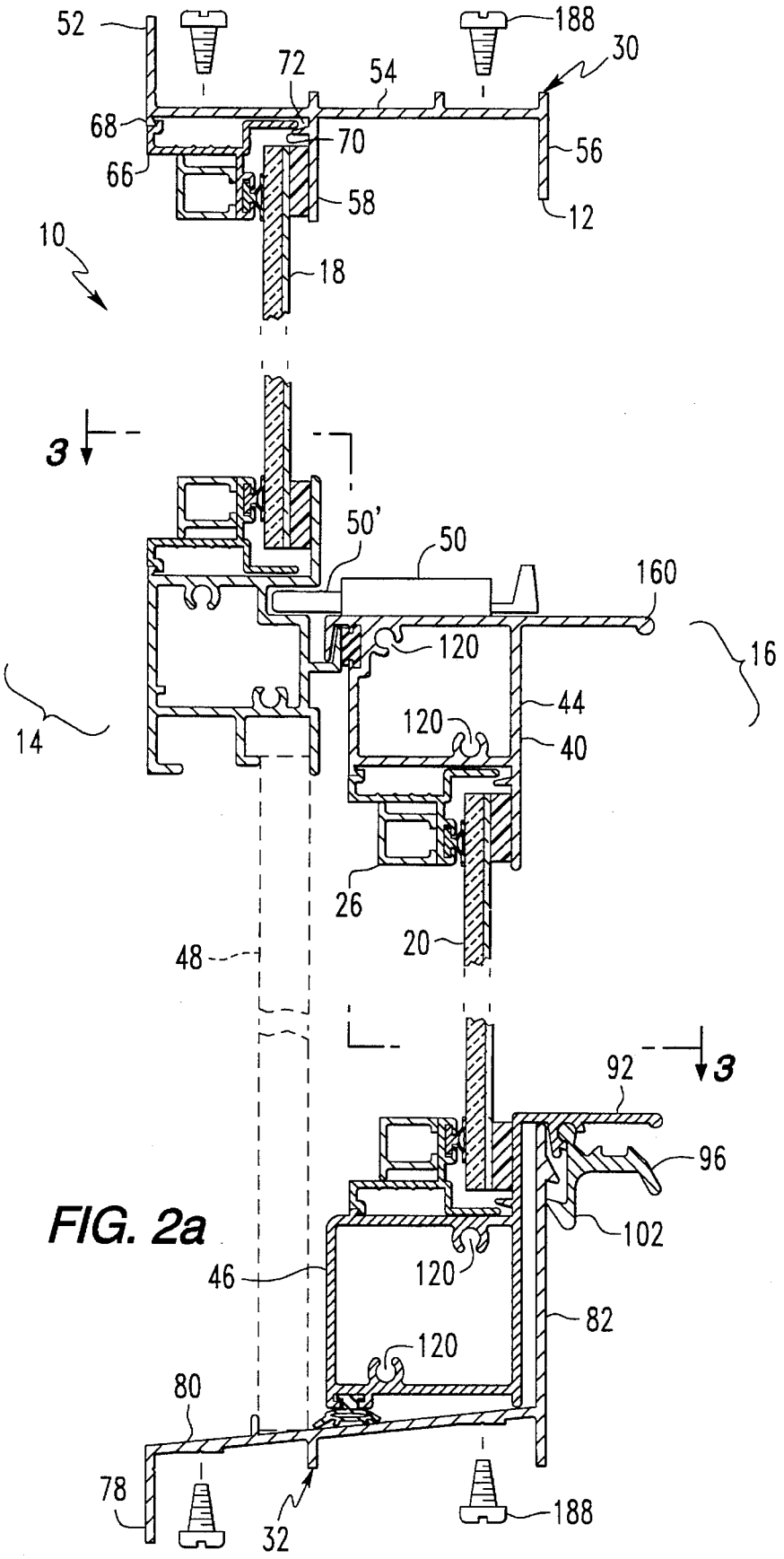
FIG. 2*a* is an enlarged partial section view taken along line 2—2 in FIG. 1.

The glazing 18 of the fixed sash 14 is attached horizontally between the spaced jamb members 28 and vertically between the head member and meeting rail 30 and 34. The glazing 20 of the movable sash 16 is mounted in a sash frame 40 that is movably carried by the window frame 10. The sash frame 40 comprises spaced side rails 42 having upper and lower end portions flanking opposite ends of a top and bottom rail 44 and 46, respectively (for top rail 46, see, e.g.. FIG. 2*a*). The rails 42–46 of the sash frame 40, as well as the meeting rail 34, comprise extruded segments of aluminum, preferably, other similar materials also being possible. Rails 42–46 of the sash frame are preferably connected together by screw fasteners.

This general arrangement of a fixed sash 14 and movable sash 16 is known in the window art as a single-hung window. In a double-hung window embodiment, both sashes are movable. The window 10 of the invention can also be double-hung, a single-hung arrangement being shown for exemplary purposes only not to limit the invention to a single-hung embodiment only.

FIG. 2*a* is vertical section view of the window 10 and shows that the movable inner sash 16 moves in an inner vertical plane relative to a spaced outer plane extending through the fixed sash 14 (the outdoor-to-indoor direction being left to right in FIG. 2*a*). An optional screen sash 48 is shown in broken lines, mountable on the outdoor side of the movable sash. The top rail 44 carries a latch 50 with a sweeping hand-lever operative to drive a retractable tongue 50' to the left in FIG. 2*a* via a cam mechanism (not in view). The retractable tongue 50' is extendible into cooperatively sized recess 180 (see FIG. 2*b*) in the meeting rail 34 to lock the movable sash 16 in the position shown in FIG. 2*a*.

Figure 2B:
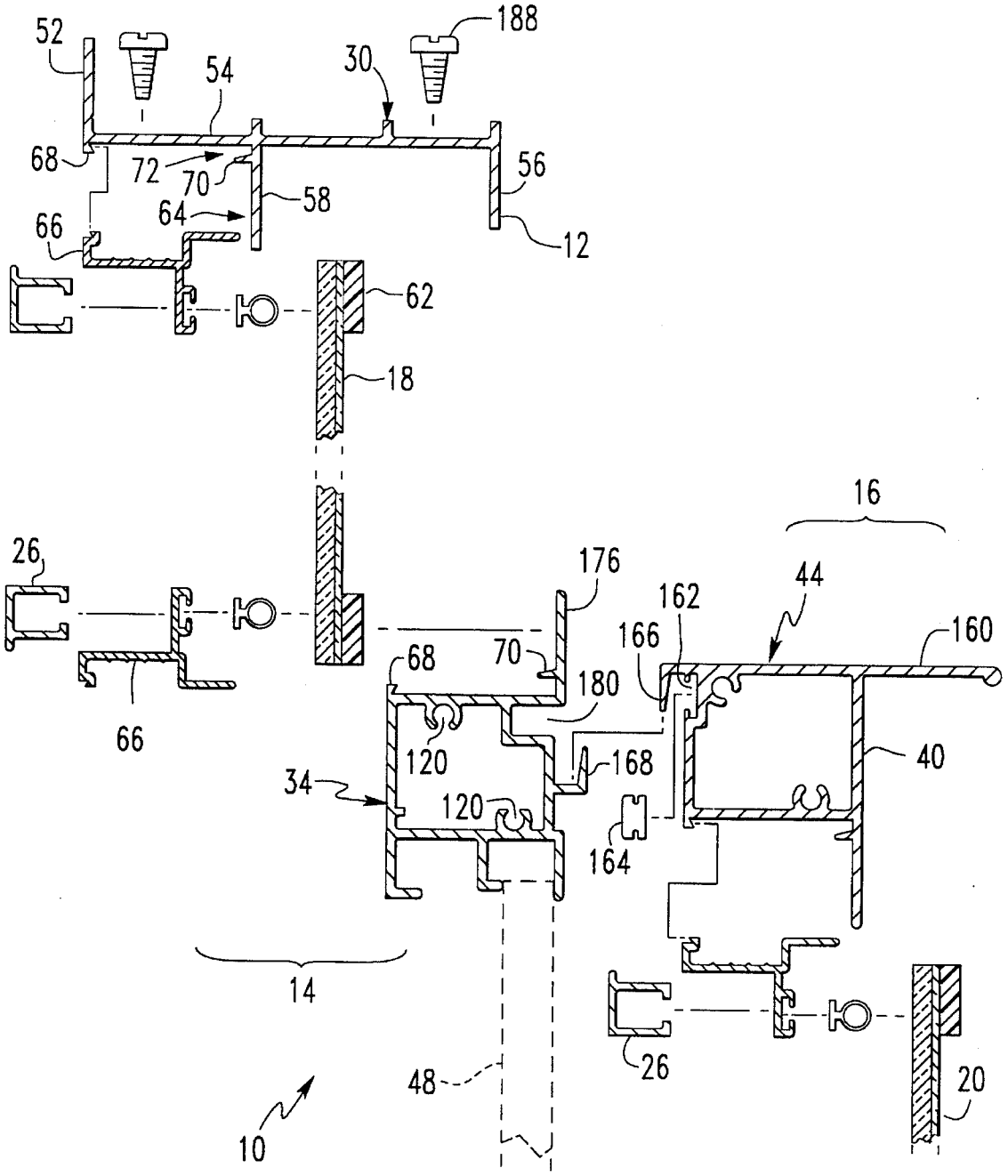
FIG. 2*b* is an exploded view corresponding to an upper portion of FIG. 2*a;*
Figure 2C:
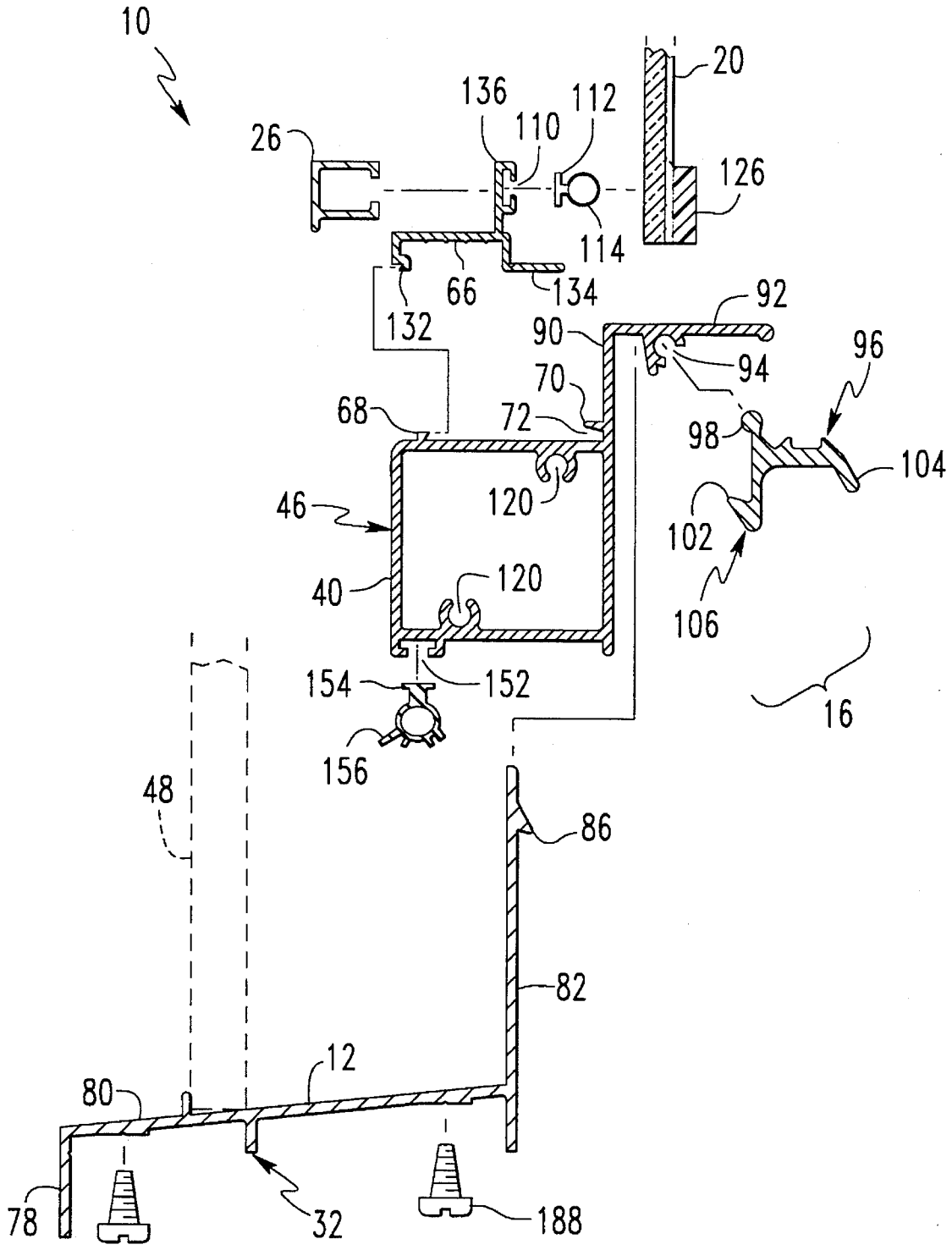
FIG. 2*c* is an exploded view corresponding to a lower portion of FIG. 2*a;*

With general reference to FIGS. 2*a*–2*c*, head member 30 of window frame 12 includes an upstanding flange 52 for overlapping and anchoring to a structural member (not shown) of the building in which the window is installed. Preferably, anchors (not shown) like lag bolts or wood screws are used for fastening the upstanding flange 52 to structural members of the building such as adjacent studs. Head member 30 includes a web portion 54 that extends from the upstanding flange 52 to an inner depending flange 56. The head member 30 is formed with an intermediate flange 58 between inner depending flange 56 and outer upstanding flange 52. Web portion 54 has an upper surface formed with three parallel ribs that not only stiffen the frame but also act as spacers against the building structure to permit clearance for the heads of screws.

Intermediate flange 58 defines a glazing bearing surface 64 (see FIG. 2*b*) against which adhesive 62 supporting the glazing 18 is applied. An additional aspect of the head member 30 involves a pair of locking formations for receiving and securing a glazing bead 66. The glazing bead 66, like the frame and rail members 28–34 and 42–46, is preferably a segment of an extruded piece, such as extruded aluminum. An outer one of the locking formations is defined by a lip 68 on web portion 54, located below the upstanding flange 52, which lip 68 has an inclined surface. The inner one of the formations is defined partly by a tab 70 formed on the intermediate flange 58, as well as portions of the intermediate flange 58 and web portion 54, which cooperatively define a locking slot 72.

The sill member 32 (FIGS. 2*a* and 2*c*) includes an outer dependent flange 78 for overlapping and anchoring to a structural member of the building by anchors (not shown). Sill member 32 includes a web portion 80 that extends from the outer depending flange 78 to an inner upstanding flange 82 and is inclined downwardly for drainage to the outside. The web portion 80 has a lower surface formed with two parallel ribs that act as spacers against the building structure to permit clearance for the heads of screws, and an upper surface formed with a rib to catch screen sash 48. The inner upstanding flange 82 has an inner surface formed with a latching tab 86 (see FIG. 2*c*) to perform a latching function with movable sash 16.

The bottom rail 46 of the sash frame 40 has a box-like main portion, and an inner sidewall which has an upward extension 90 terminating in an inwardly extending flange 92. Flange 92 defines a manually graspable element of the sash frame 40 to permit a user to handle the movable sash 16 and to move it between open and shut positions (the shut position being shown in FIGS. 1 and 2*a*). Flange 92 has a lower surface formed with a C-shaped slot 94 that has an opening facing downwardly and inwardly. Slot 94 is sized and shaped to carry a pivoting latch bar 96 that can engage with tooth 86 of sill flange 82 when the sash 16 is closed.

The pivoting latch bar 96 is an alternative to the latch 50, to lock the movable sash 16 in the down position (as shown in FIG. 2*a*) in the window frame 12. The latch 50 is generally preferred over the latch bar 96. The latch bar 96 is preferred in special cases to meet the fire codes of some localities that require the window latching mechanism to be located within reach of rather small children.

Latch bar 96 extends left to right substantially between the left and right rails 42 (see FIG. 1). Latch bar 96 has a substantially cylindrical axle portion 98 pivotably carried in slot 94 and a hook portion 102 for catching the latching tab or tooth 86 on sill member 32, which results in the sash 16 being immovably secured in the down or shut position in the window frame 12. Latch bar 96 further includes a cantilever portion 104, the weight of which normally urges the latch bar 96 clockwise relative to the position shown in FIG. 2*a*, i.e., into a locking position at which hook portion 102 abuts upstanding flange 82 of sill member 32.

The hook portion 102 includes a tapered cam surface 106 (see FIG. 2*c*) facing downwardly, so that as the movable sash 16 is moved downwardly toward the shut position, the cam surface 106 slides over latching tab 86 on sill member 32, after which hook member 102 swings clockwise into the latched position shown in FIG. 2*a*. Thus, latch bar 96 automatically latches onto latching tab 86 when sash 16 is shut. Latch bar 96 is movable to an unlatched position by upward pressure on cantilever portion 104, typically by the user squeezing flange 92 and portion 104 together.

The bottom rail 46 has a lower sidewall with an external surface that is formed with a T-shaped groove 152 shaped and arranged to receive the T-shaped tongue 154 of a resilient seal or weatherstrip 156, and has a rib for abutting the sill member to limit the travel of the movable sash 16 at an extreme downward position.

Figure 3B:
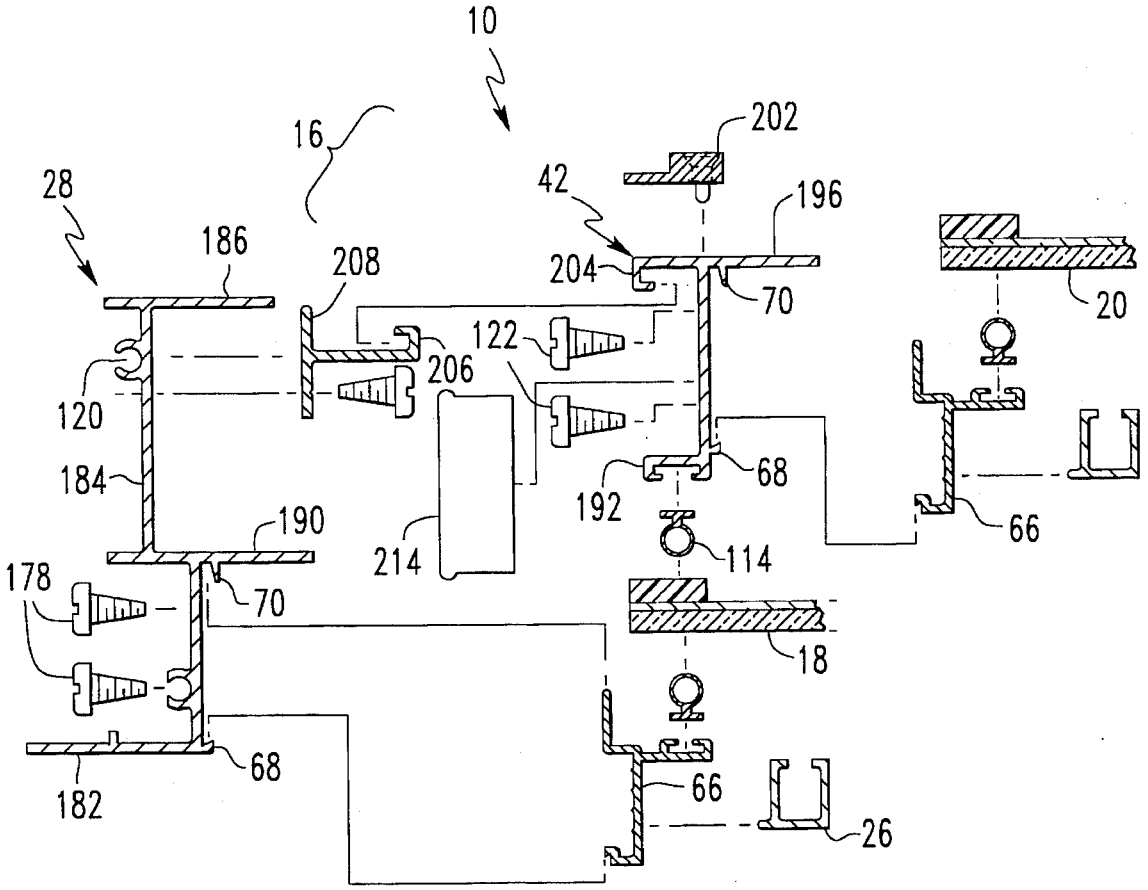
FIG. 3*b* is an exploded view corresponding to the left part of FIG. 3*a*, the right part being a mirror opposite; and, FIG. 4 is an enlarged view of a detail of a lower sash rail in FIG. 2*a*, with portions broken away.
Figure 4:
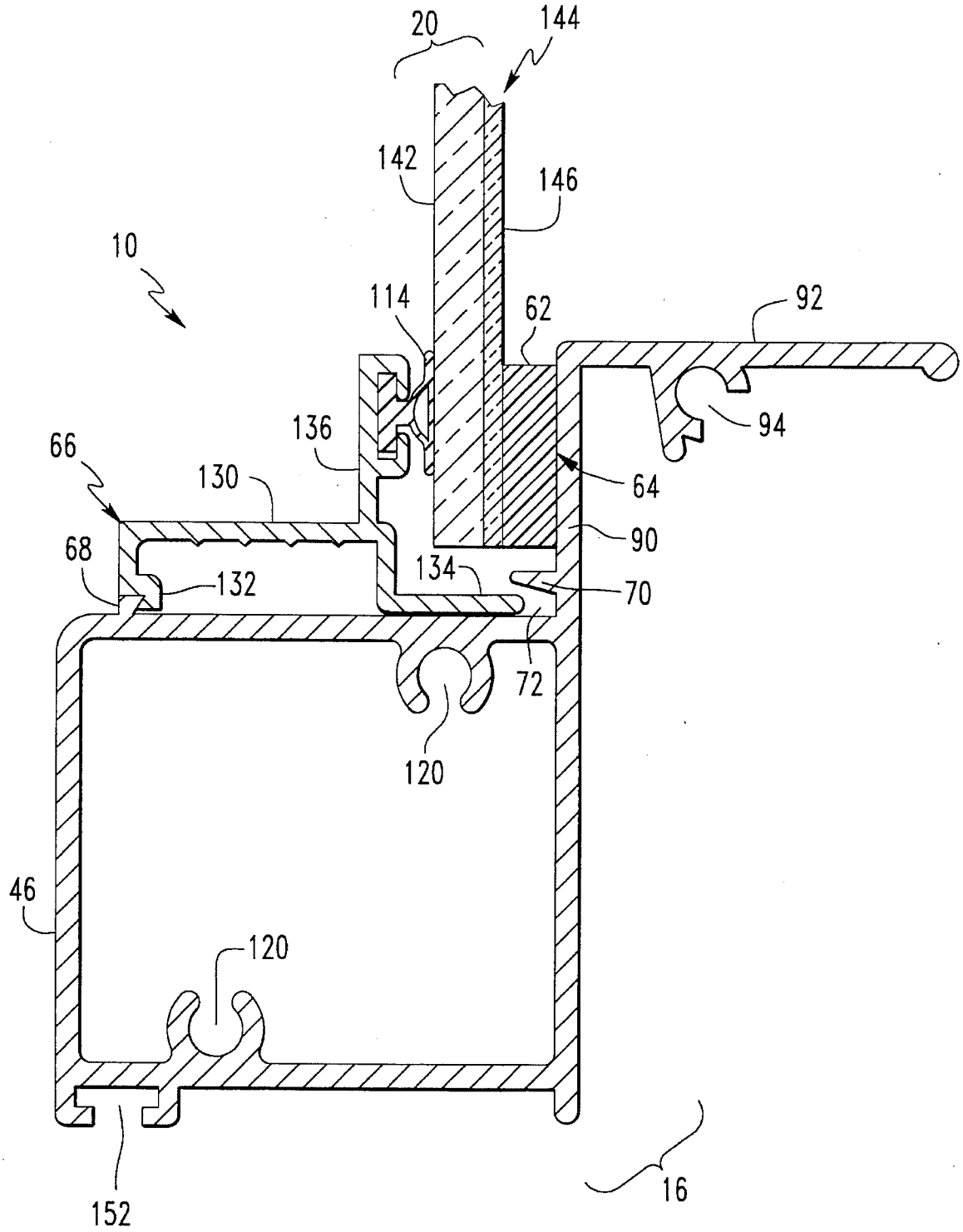

FIG. 4 is a detail of the lower portion of the movable sash 16. The bottom rail 46 lower sidewall has an internal surface that is formed with a C-shaped boss 120. The upper sidewall has an internal surface likewise formed with a C-shaped boss 120, these bosses 120 being sized to accept the spiral threads of self-tapping screws 122 (FIG. 3*b*). Screws 122 are aligned through holes (not shown) in one or the other of the side rails 42 and tightened in the C-shaped bosses 120 (FIG. 4) to secure the side rails 42 (FIG. 1 ) and bottom rail 46 together in a butt-joint fashion.

In FIG. 4, the bottom rail 46 is formed with a locking lip 68. The upward extension 90 has a locking tab 70 which together with portions of the upward extension 90 and upper sidewall define a slot 72. The locking lip 68 and slot 72 are spaced and arranged to secure a glazing bead 66 in a fixed position as shown. The upward extension 90 of the bottom rail 46 has an outer surface defining a glazing bearing surface 64 against which adhesive 62 supporting the glazing 20 is applied, in a manner similar to that discussed above with reference to the fixed sash 14.

Glazing bead 66 (FIGS. 2*c* and 4) includes a channel-shaped base portion 130 (an inverted-U shape as shown) with opposite arms, one of which terminates in a locking lip 132 and the other of which terminates in a locking flange 134. Additionally, the glazing bead 66 includes a seal or weatherstrip-carrying flange 136. Flange 136 forms a T-shaped groove 110 for receiving a T-shaped tongue 112 of a resilient seal 114, the bearing part of which is resilient, e.g., hollow and tubular. Locking lip 132 and flange 134 are sized and arranged for engagement simultaneously with the locking lip 68 and slot 72, respectively, of the bottom rail 46, such that glazing part 66 is snapped into secure engagement. By these arrangements, glazing bead 66 can be press fit into engagement with rail 46 without requiring additional fasteners.

Glazing 20 preferably comprises a three-ply construction including an outer layer of annealed glass 142 (FIG. 4), a middle layer of a polymer 144, and an inner film 146 coating the polymer 144 for increased abrasion resistance. Polymer 144 can comprise any suitable variety of thermosetting or thermoplastic polymer for absorbing impacts and/or deforming forces, including but not limited to vinyl polymers, preferably polyvinylacetal polymers, and most preferably polyvinyl butyral and polyvinyl formal polymers. Film 146 can comprise any suitable variety polymer resistant to lacerating, including but not limited to groups chosen from polyvinylalchohol and polyethylene terephthalate polymers. The glazing 20 is oriented such that the glass side preferably faces outdoors and the polymer side faces indoors.

Glazing 20 is installed before glazing bead 66. Bottom rail 46 is prepared for the glazing 20 by application of a viscous bead of adhesive 62 such as silicone or room temperature cured vinyl glue, at the glazing bearing surface 64 of the bottom rail 46. Glazing 20 is placed against the viscous bead of adhesive or glue 62, and glazing bead 66 is readied for attachment to sill bottom 46. Locking flange 134 is guided into locking slot 72, and then the complementary locking lips 68 and 132 are forced together until they snap over one another to engage each other. As a result, glazing bead 66 is securely fixed. Additionally, the glazing 20 is sealingly and resiliently clamped across its sides between the combined adhesive bead and upward extension 62 and 90 on the inside, and the combined resilient weatherstrip and glazing bead 114 and 66 on the outside.

With more general reference to FIGS. 2*a*–2*b*, top rail 44 of sash frame 40 has a box-like main portion, and a graspable flange 160 extending from an upper and inner corner. The box-like main portion of top rail 44 has an outer sidewall formed with a T-shaped groove 162 (FIG. 2*b*) sized to receive a T-shaped tongue of a resilient seal or weatherstrip 164. The outer sidewall has a hook member 166 for hooking a complementary hook member 168 of the meeting rail 34, partly for limiting the downward travel of the sash 16 in the window frame 12, and partly for defining a closure for the window 10. The lower and upper sidewalls have internal surfaces formed with a C-shaped bosses 120, respectively, which permit fastening to the side rails 42 (FIG. 1) by screws 122 (FIG. 3*b*) in butt-joint fashion similar to that discussed above.

Meeting rail 34 similarly includes a box-like main portion, an upward extension 176 formed with a locking tab 70, a locking lip 68, and internal C-shaped bosses 120 which permit fastening between the jamb members 28 (FIG. 1) by screws 178 (FIGS. 3*a* and 3*b*) in butt-joint fashion. The locking lip and tab 68 and 70 (FIG. 2*b*) are spaced and arranged to secure a glazing bead 66 and glazing 18 in fixed positions as shown. Meeting rail 34 additionally includes an inner sidewall formed with a slot 180 that is sized and arranged for accepting the retractable latching tongue 50' of latch 50 on the top rail 44, which latch 50 is of a conventional cam-type window latch.

Figure 3A:
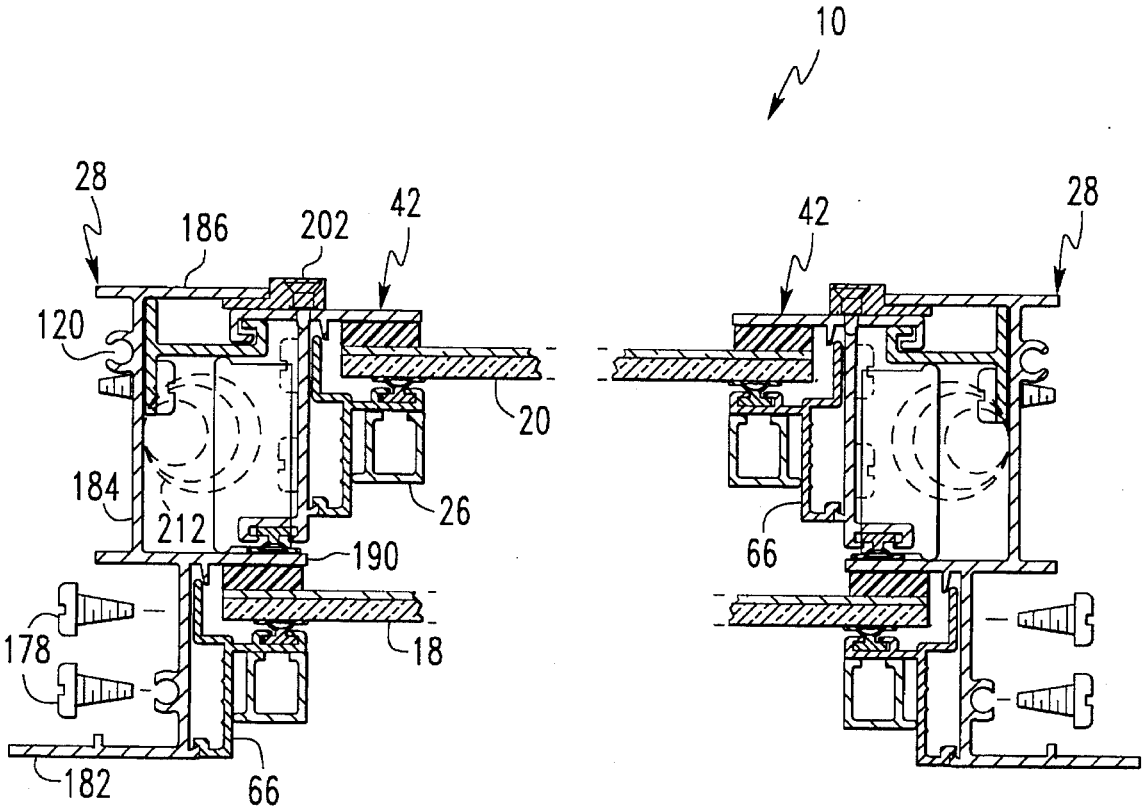
FIG. 3*a* is an partial section view taken along offset line 3—3 in FIG. 2*a;*

In FIGS. 3*a* and 3*b*, the left and right halves are mirror opposites, wherein the left jamb member 28 is described as representative of the right. Thus, the left jamb member 28 includes an outer flange 182 that extends in the distal direction (relative to the window's vertical center line, not shown). The outer flange 182 is arranged for overlapping and anchoring to the structural members of the building, preferably by anchors (not shown). Left jamb member 28 has a web portion 184 that extends from the outer flange 182 to an inner flange 186 that extends in the proximal direction. Web portion 184 is formed with two parallel ribs which, with a tab on the outer flange 182, space against the building structure to permit clearance for the heads of screws. C-shaped bosses 120 permit fastening between the head and sill members 30 and 32 (FIG. 1 ) via screws 188 (FIGS. 2*a*–2*c*) in butt-joints as above.

The jamb member 28 has an intermediate flange 190 (FIGS. 3*a* and 3*b*) that extends in the proximal direction, which intermediate flange 190 has an outer surface (the indoor-to-outdoor direction being up to down in FIGS. 3*a* and 3*b*) formed with a locking tab 70 (FIG. 3*b*). Left jamb member 28 has an outer proximal corner formed with a locking lip 68, the locking lip and tab 68 and 70 being spaced and arranged to secure a glazing bead 66 and glazing 18 in fixed positions as shown. The intermediate and inner flanges 190 and 186 are spaced apart to define a channel in which the sash 16 moves.

The left rail 42 of the sash 16, as representative of the right, is generally T-shaped, with an outer edge 192 of the left rail 42 defining a foot of the T-shape, and an inner end defining the head of the T-shape. The outer edge 192 is formed with a locking lip 68 on the proximal side and T-shaped groove on the distal side, sized to receive a T-shaped tongue of a resilient seal or weatherstrip 114. The weather strip 114 has a resilient, e.g., hollow, main body which slides along a surface of the intermediate flange 190 of the left jamb member 28.

The inner end of left side rail 42 comprises a proximal flange 196 formed with a locking tab 70, which coacts with the locking lip 68 to secure a glazing bead 66 and glazing 20 in fixed positions as shown. The distal flange carries a nylon slide 202 on an inner surface thereof for sliding against a surface of the inner flange 186 of the left jamb member 42. The distal flange of rail 42 terminates in the distal direction in a hook 204 to complement a hook 206 of a guide member 208. The guide member 208 is fastened to the left jamb member 28. The complementary hook portions 204 and 206 cooperate to guide the sash 16 in a preferred path during movement to avoid binding and the like.

FIGS. 3*a* and 3*b* additionally depict a balance cover 212 (FIG. 3*a* only) and balance top plate 214 for a sash balance (not shown) to counteract part of the weight of the movable sash 16 during movement thereof. The balance preferably comprises a coil tension spring (not shown), or another structure as known in the art.

Window 10 is particularly durable and has been successfully tested under conditions characteristic of strong storms such as hurricanes. More particularly, the window according to the invention has been found to meet criteria of the building code of Dade County, Fla., promulgated to provide standards for windows resistant to hurricane winds, windborne debris and the like, namely South Florida Building Code sections 2314.5 and 2315, as construed with the Building Code Compliance Office of Dade County's protocols PA 202-94, PA 201-94 and PA 203-94 (hereinafter called "the code provisions" collectively).

Briefly, compliance with the code provisions involved testing three specimen windows under test protocols involving subjecting each specimen to a static pressure test, an impact test, and a cyclical loading test, pursuant to protocols PA 202-94, PA 201-94 and PA 203-94, respectively.

Preliminarily, a specimen window is attached to a suitable fixture for mounting in a test chamber. The specimen window is supported by and secured to the respective fixture by the same number and type of anchors to be approved for normal installation of the window in a building. No sealing or construction material that is not normally used is employed to attach the specimen window to a fixture.

Under the static load test, the specimen window is subjected to a defined maximum static load, namely that equal to a static air pressure based on a wind velocity of 75 mph (120 kph). In addition to the static load there is water spray. One-half of the defined maximum load is applied to the outdoor side of the specimen window, sustained for 30 seconds and released. After a recovery of 10 seconds, one-half of the defined maximum load is applied to the indoor side of the specimen window, and sustained for 30 seconds before release. Next the specimen window is permitted a recovery period of between 1 and 5 minutes, after which the defined maximum load is applied to the outdoor side of the specimen window and sustained for 30 seconds. Following a recovery of 10 seconds, the defined maximum test load is applied to the indoor side of the specimen window and sustained for 30 seconds. Water is sprayed onto the outdoor side of the specimen window, at a minimum rate of 5 gph/ft$^2$ (200 lph/m$^2$) and at a pressure equal to not less than 15% of the full test load, sustained for not less than 15 minutes. Compliance requires that no water infiltration shall occur.

Under the impact testing protocol, an air cannon is arranged to launch missiles at a specimen window. A preferred missile is a combination of a timber of solid S4S nominal 2×4 #2 surface dry Southern Pine (nominal 5 cm×10 cm), between 7 and 9 feet long (2.1 and 2.7 m), with a sabot attached to a trailing edge of the timber to facilitate launching, the combined weight of the timber and sabot being between 9 and 9.5 lbs (4 and 4.3 kgs). The missile is launched at the specimen window to achieve a speed at impact of at 34 mph (55 kph).

Each specimen window receives two impacts. Specimen window number one is impacted once at the meeting rail, and once at the center of the glazing in the sash frame. Specimen window number two is impacted once at the center of the glazing in the sash frame, and once at the bottom rail of the sash frame, 6 inches (15 cm) from a bottom corner. Specimen window number three is impacted once at the bottom sash frame rail 6 inches (15 cm) from a bottom corner, and once at the meeting rail. After having been so impacted, and presumably dented, each specimen is subjected to the third protocol.

Each specimen window is returned to a pressure chamber, and cyclically loaded for 9000 cycles, at selected pressure differentials ranging up to a defined maximum of 70 lbs/ft$^2$ (3.35 Kpa). Indeed, all the samples constructed in accordance with the invention not only survived 70 lbs/ft$^2$ (3.35 Kpa) but also showed signs of being able to withstand more. Although, the test envelope was not actually extended beyond a maximum of 70 lbs/ft$^2$ (3.35 Kpa). The pressure differentials ramp up during one half the cycles and down during a second half. More particularly, 50% of the maximum defined differential applied to the outdoor side of the window at 3200 cycles, 100% is developed at 4500 cycles, immediately after which the pressure differential is reversed so that 100% of the maximum is applied to the indoor side of the specimen window, following which the pressure differential ramps down until as 50% of the maximum is applied to the indoor side at 7700 cycles, and so on.

The results for the three specimen windows are examined as to whether the three specimens collectively complied with the criteria defined in the code. Compliance with the code requirements, although not foolproof or representative of all possible storm conditions, is generally deemed to indicate that the window is a useful part of the external protection of a building envelope, likely to withstand expected storm emergencies such as hurricanes and the like.

During differential testing, specimen windows in accordance with the invention were observed to flex. A center of the meeting rail 34 was observed to arch out from a line intersecting its ends by up to 1.5 inches (3.8 cm); a center of geometry of the glazing 20 in sash frame 40 was observed to stretch away from a plane generally containing its four edges by up to 4 to 5 inches (10 to 12.7 cm); and, a center of sash bottom rail 46 simultaneously twisted together with the glazing to arch out by up to an inch (2.54 cm).

The window 10 of the invention has an overall structure that is durable enough to withstand anticipated impact, and is flexible and resilient for withstanding anticipated wind force and rain. Advantageous aspects of the overall structure include, among others, the hollow rails and thin frame members, the screw fastening system including the C-shaped bosses, the safety glass, and the means of attaching the glazing. Although durable, the window materials and their assembly as described can be accomplished at a reasonable expense for use in typical buildings.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A storm resistant window construction comprising:

a frame having frame members including spaced left and right members connected to top and bottom members for supporting glazing mounted inwardly of the frame members, the glazing comprising a laminate of glass and a coextensive polymer film on one surface of the glass;

each frame member including locking formations for attaching the frame members to one another;

resilient adhesive affixed between the frame and the polymer film, the adhesive attaching the glazing to the frame; and, a glazing bead having a base portion and a flange protruding inwardly of the frame and bearing against the glazing on a side of the glazing opposite from the polymer film, the base portions of the glazing bead having means for attachment to the frame members such that the glazing is gripped between the frame and the flange with the gazing structurally attached to the frame members via the adhesive.

2. The window construction of claim 1, further comprising a resilient seal bearing between the frame and the glazing on a side opposite from the adhesive such that the adhesive is affixed between the polymer film and the frame, and the resilient seal abuts the glass.

3. The window construction of claim 1, wherein the frame members comprise extruded aluminum.

4. The window construction of claim 1, wherein the adhesive comprises a room temperature curing polymer.

5. The window construction of claim 1, wherein the resilient seal comprises a polymer extrusion having an enlarged portion for deforming against the glazing, and a locking tongue extending from the enlarged portion for attaching to a complementary groove formed in one of the glazing bead and the frame members.

6. The window construction of claim 1, further comprising at least one movable sash mounted in said frame of the window construction, wherein said window construction defines one of a single-hung window arrangement, a double-hung window arrangement, a window arrangement wherein the at least one movable sash is horizontally slidable, and a sliding glass door arrangement, the frame members being disposed peripherally thereon.

7. A storm resistant window construction comprising:

a frame having frame members including spaced left and right jamb members connected to head and sill members;

glazing having an inside surface and outside surface and edge surfaces, the glazing comprising a laminate of glass and a coextensive polymer film, disposed in the sash-frame with the polymer film being on the inside surface and disposed toward the frame, and wherein the edge surface is spaced edgewise from the frame around substantially an entire periphery of the frame;

resilient adhesive attaching the glazing to the sash-frame, the adhesive being disposed between and affixing the polymer film to the frame;

glazing beads disposed on the frame such that the glazing beads grip the glazing against the frame with the glazing being attached to the frame by the adhesive affixing the polymer film.

8. The window construction of claim 7, comprising at least one sash-frame movable between open and shut positions, the frame members including upper, lower, left and right sash rails.

9. The window construction of claim 8, further comprising a latch mounted on at least one of the sash rails for locking the sash relative to the frame.

10. The window construction of claim 7, wherein the rails and frame members comprise extruded aluminum.

11. The window construction of claim 7, wherein the adhesive comprises a room temperature curing polymer.

12. The window construction of claim 7, further comprising a resilient seal between the bead and the glass, comprising a polymer extrusion having an enlarged portion for deforming against the glazing, and a locking tongue extending from the enlarged portion for attaching to a complementary groove formed in one of the glazing beads and the sash rails.

13. The window construction of claim 7, wherein the window construction defines one of a single-hung window arrangement, a double-hung window arrangement, a window arrangement with at least one movable sash-frame, and a sliding glass door arrangement.

* * * * *